United States Patent [19]

Monfardini

[11] 4,060,267

[45] Nov. 29, 1977

[54] ADJUSTABLE DOOR LATCH

[76] Inventor: Paul Monfardini, 744 Chandler Road, Gurnee, Ill. 60031

[21] Appl. No.: 693,307

[22] Filed: June 7, 1976

[51] Int. Cl.[2] ..... E05C 1/12

[52] U.S. Cl. ..... 292/173; 292/143; 292/DIG. 31; 292/DIG. 57; 292/DIG. 60

[58] Field of Search ..... 292/166, DIG. 60, DIG. 31, 292/173, 143, DIG. 73, DIG. 57; 70/145, 146 Y, 208, 461, 146 R

[56] References Cited

U.S. PATENT DOCUMENTS

| | | | |
|---|---|---|---|
| 1,904,053 | 4/1933 | Katz | 292/166 X |
| 2,121,596 | 6/1938 | Hill | 292/173 |
| 2,592,239 | 4/1952 | Brown | 292/DIG. 60 |
| 2,736,591 | 2/1956 | Roethel | 292/166 |
| 2,900,204 | 8/1959 | Pelcin | 292/173 |
| 3,209,563 | 10/1965 | Pelcin | 292/173 X |
| 3,707,862 | 1/1973 | Pastva | 292/DIG. 31 |

*Primary Examiner*—Roy D. Frazier
*Assistant Examiner*—Rodney H. Bonck
*Attorney, Agent, or Firm*—Darbo & Vandenburgh

[57] ABSTRACT

The bolt of a door latch or lock is made laterally adjustable to ensure both proper latching operation upon closing the door and also reasonably firm engagement of the catch with the fixed stop to ensure firm holding without vibratory or rattling movement. The adjustment is accomplished by adjusting the angle of emergence of the bolt with respect to the latch structure, e.g., the bolt case. The adjustment capability allows greater tolerance in the mounting of the latch upon the door.

7 Claims, 7 Drawing Figures

ADJUSTABLE DOOR LATCH

BACKGROUND AND SUMMARY OF THE INVENTION

While light hinged doors, such as kitchen cupboard doors, which are not subject to forces which tend to open them unintentionally, may be held in closed position with such simple devices as springs, magnets or friction catches, doors which must resist unintentional opening as a consequence of relatively substantial forces require positive latches or locks. Such positive holding devices usually comprise a bolt mounted within a box or case enclosure at the edge of the door opposite the hinges with allowance for limited reciprocating movement so that the catch can emerge to engage fixed stop structure and be retracted to permit opening and closing of the door. Springs usually are provided to urge the bolt outwardly toward extended position, especially in a latch, a manually operable handle or lever being provided to retract the bolt when the door is to be opened. A latching device may or may not be provided with locking means.

Because it is desirable by means of the door latch to dependably hold the door closed without allowing movement while in the closed position that might cause annoying noise, it has been necessary to observe relatively close tolerances in mounting the cooperating latch and fixed stop. The catch must engage the stop and hold the door against the fixed structure to which it is hinged. Frequently, adjustments had to be made after the latching equipment has been mounted to correct a loose condition. The requirements of accuracy and possible necessity of changing the mounting resulted in increased labor costs in the achievement of quality construction.

The latch or lock of this invention permits much greater tolerance in the relative positions of the latching mechanism and the fixed stop when the parts are being installed so that less time and care is involved in mounting the equipment. After mounting has been completed, the position of the catch with respect to the fixed stop is easily adjustable by turning with a screwdriver a control post at the rear end of the latch bolt to alter the angle of emergence of the bolt from the case enclosure. A small hole is provided in the top of the bolt case to permit access to this adjusting post when the bolt is extended with the catch confronting the fixed stop. The post is turned until a light but sufficient pressure is achieved between the catch and the stop so that with the application of ordinary forces, the door is held against any movement.

Accordingly, the principle object of the invention is to provide a hinged door latch or lock having a bolt the angle of emergence of which may be adjusted over a limited range to adjust the position of the catch relative to the fixed stop surface to hold the door firmly in closed position.

DESCRIPTION OF THE DRAWING

In the accompanying drawing.

DESCRIPTION OF PREFERRED EMBODIMENT OF THE INVENTION

Figure 1:
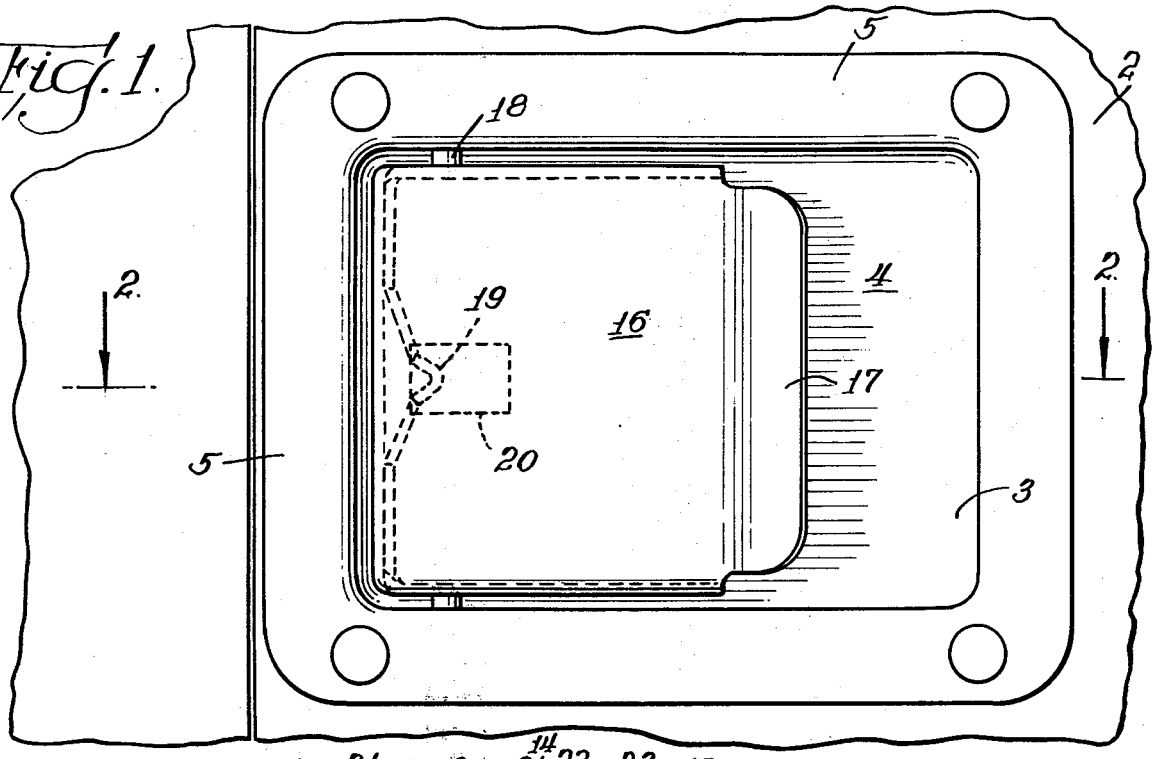
FIG. 1 is a plan view of a latch mounted upon a door.

For simplicity and clarity, and as a typical example, the invention will be described as embodied in a spring latch mounted upon a hinged door and having a handle which serves both to withdraw the bolt and pull the door open.

Such a latch is shown in the drawing. If is of the flush type, recessed in an opening 1 in door 2. The handle recess 3 is defined by a tray-like handle housing 4 having a peripheral flange 5 by which it is mounted upon the door.

Bolt case 6 having an open front 7 is permanently mounted upon the surface of housing 4 as by spot welding. The lock bolt 8 comprises a relatively thick, rectangular body 9 and a narrower catch 10 extending outwardly from the body at its median. The end of the catch has the usual inclined, cam surface 11 to effect retraction of the bolt when the door is slammed shut.

Figure 3:
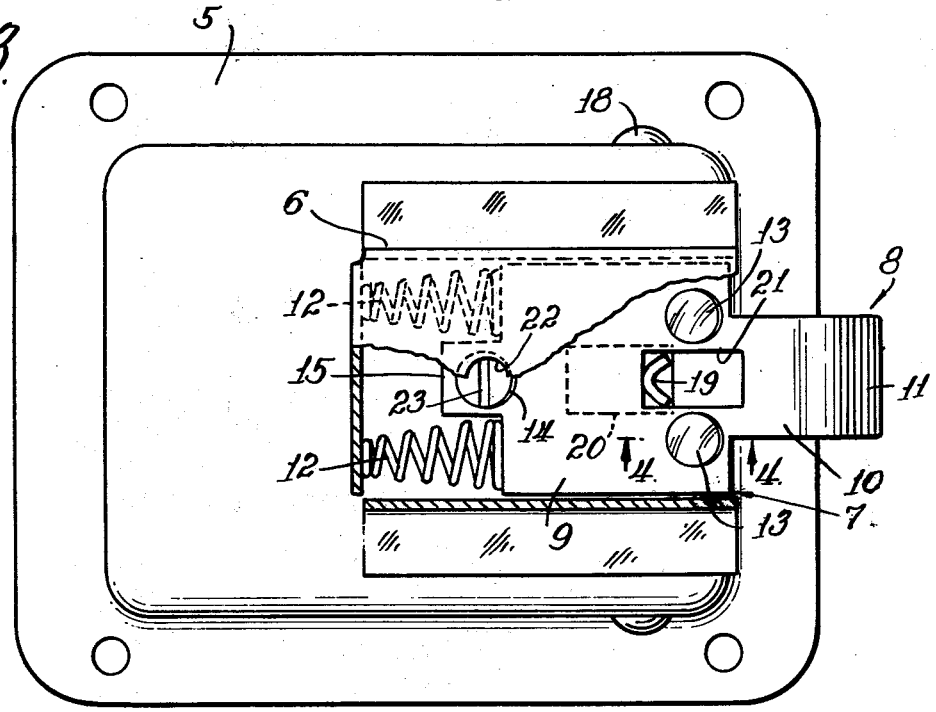
FIG. 3 is a bottom plan view, partly in section, of the latch of FIGS. 1 and 2.

As can be best seen in FIG. 3, the width of the body 9 of the bolt is slightly less than the inside width of bolt case 6 so that the sides of the case serve to restrict the movement of the bolt to reciprocation along its axis. A pair of compression springs 12 bear against the bolt to urge it outwardly. Just as sidewise movement of the bolt is prevented by the sides of case 6, lateral movement of the bolt is prevented by a pair of fulcrum elements 13, which are mounted in the forward part of bolt body 9, and a post 14 which, in accordance with the invention, is adjustably mounted in the rear of body 9. Thus, the bolt is constrained to axial reciprocating movement. Advantageously, the mounting of the post 14 may be located in a median extension 15 at the rear of bolt body 9, this extension serving also to hold springs 12 in position.

A latch handle 16 having an out-turned lip 17 to facilitate the entry of a person's fingers to lift the handle is pivotally mounted within recess 3 by means of a pin 18. A lever 19 extends from the handle through a slot 20 in housing 4 into an opening 11 in bolt body 9. This lever 19 acts in opposition to the pressure exerted by springs 12, limiting the outward movement of the lock bolt to the position shown in FIG. 2 in which the handle is in its flush, rest position, and operates to retract the bolt when the handle is pulled outwardly.

Figure 4:
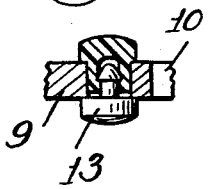
FIG. 4 is a detail view in cross section taken at the line 4—4 of FIG. 3 and showing one of the bolt fulcrum elements.

Since fulcrum elements 13 extend laterally in both directions from bolt body 9 a sufficient distance to provide an overall length of each fulcrum element slightly less than the height of the inner surface of the top of bolt case 6 above housing 4, these elements serve to prevent lateral movement of the bolt at the front end of the bolt body. To enhance the reciprocating action of the bolt, the fulcrum elements may advantageously be composed of a self-lubricating material, such as nylon. While any suitable structural design may be employed to permanently mount the fulcrum elements in position, a convenient arrangement, comprising a pair of headed parts which snap together, is shown in FIG. 4.

Figure 2:
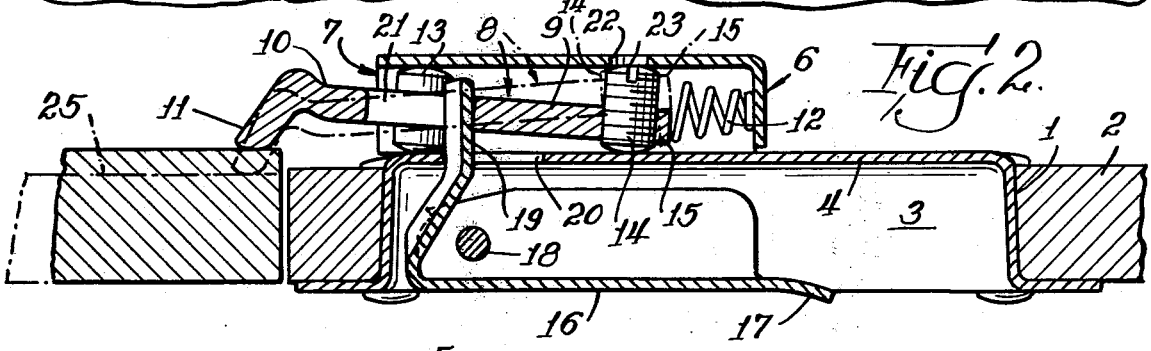
FIG. 2 is a cross-sectional view taken at the line 2—2 of FIG. 1 and showing the mechanism of the invention.

The angle of emergence of the bolt; i.e., the angle of the bolt body to the bolt case, and thus to the door, is established and controlled by post 14. As is seen in FIG. 2, post 14 is threaded into and through body 9 of the bolt and its length is the same as the length of fulcrum elements 13 so that its ends confront the surfaces of housing 4 and case 6. It may also advantageously be composed of a self-lubricating material such as nylon. An opening 22 is provided in bolt case 6 for access to post 14 and a slot 23 is provided in the end of the post which is exposed through opening 23 when the bolt is extended so that a screwdriver may be inserted to turn the post and thus adjust its position relative to the rear end of bolt body 9. Since post 14 extends between the inner surface of case 6 and the surface of housing 4, engaging these surfaces with reasonable to tolerance for sliding movement therealong, the relative movement between the adjustable post and bolt body 9 results in corresponding movement of the latter with respect to the bolt case and the door. Like post 14, fulcrum elements 13 extend between the same surfaces with reasonable tolerance permitting sliding movement therealong. Adjusting movement of the rear end of bolt body 9 is transmitted to catch 10 as a consequence of pivotal movement about fulcrum elements 13.

The approximate limits of the range of this pivotal movement is indicated by the solid line and dotted line positions of the bolt shown in FIG. 2. To bring the end of catch 10 into firm engagement with fixed stop 25, after installing the latch, post 14 is screwed through the bolt until it is no longer possible to move the closed door. If, in testing the action of the latch as the door is closed, it is found that the catch does not slide over the fixed stop, the post may be readjusted slightly to ensure this proper action.

Figure 5:
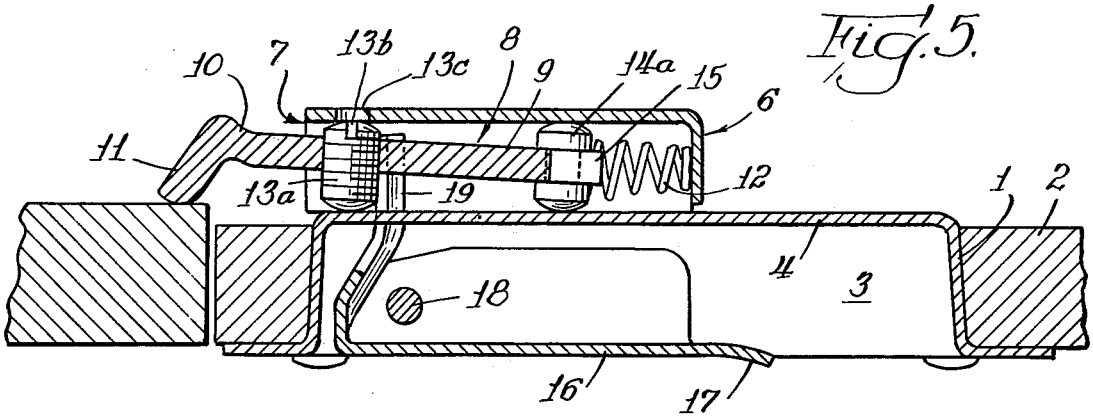
FIGS. 5 and 6 are cross-sectional views similar to FIG. 2 but showing alternative embodiments of the invention.
Figure 6:
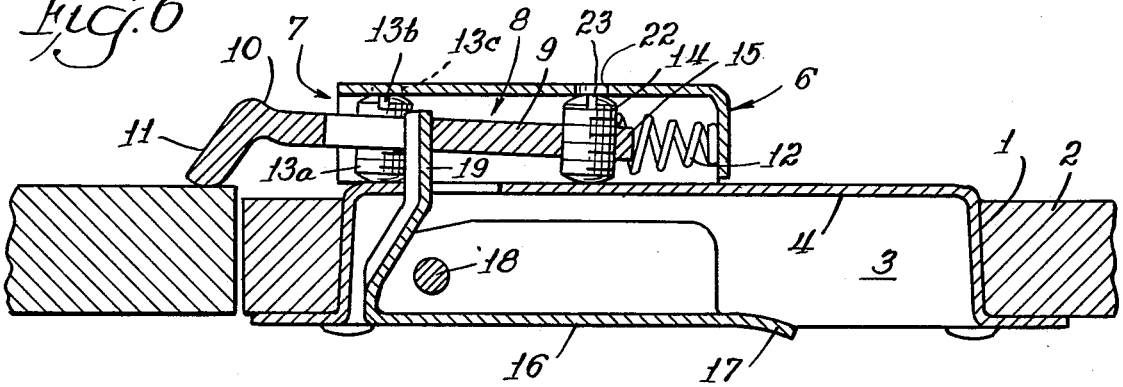
Figure 7:
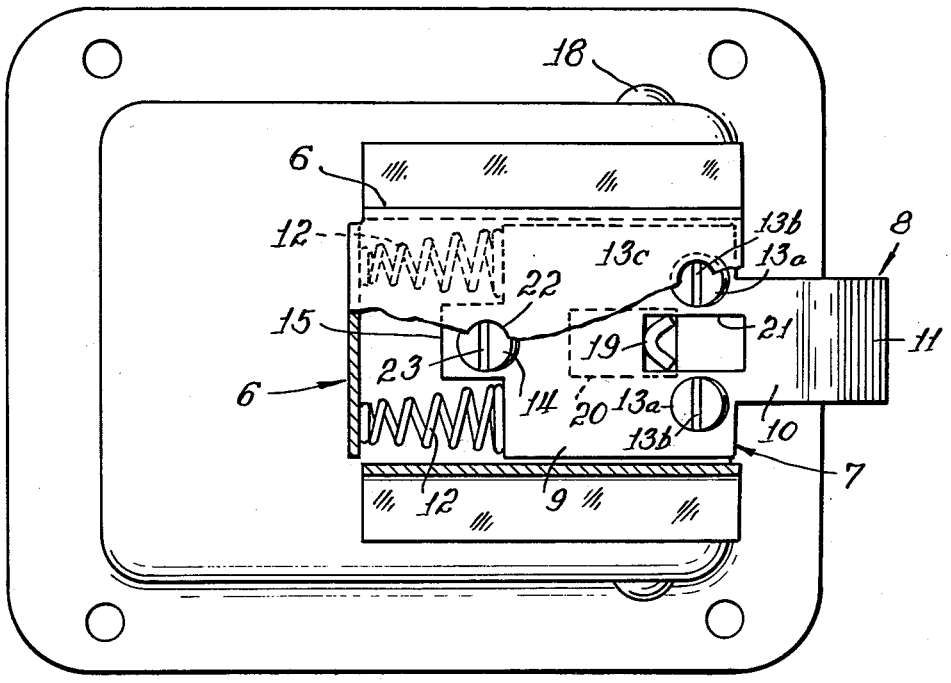
FIG. 7 is a bottom plan view, partly in section, of the latch of FIG. 6.

Alternative embodiments of the invention are shown in FIGS. 5–7. In the latch shown in FIG. 5, instead of adjustable post 14, a fixed element **14*a*, which may be similar in construction to fulcrum elements 13, is mounted in the rear of bolt body 9. Instead of fixed fulcrum elements 13 in the forward part of bolt body 9, adjustable posts 13*a*, which may be similar to adjustable post 14, are threaded through the bolt as indicated. A pair of holes 13*c* are provided in bolt case 6 for access to slots 13*b* for adjustment of these posts. It will be understood that by turning posts 13*a*** one way or other, the angle of emergence of the latch bolt is altered to accomplish the adjustment which is the objective of the invention.

A further alternative design of the latch mechanism is illustrated in FIGS. 6 and 7. This latch is similar to that shown in FIGS. 1–4 in that it employs an adjustable post 14 at the rear end of the latch bolt. However, instead of the fixed fulcrum elements 13, a pair of adjustable posts **13*a* are provided at the forward end of the latch bolt as described with reference to the latch shown in FIG. 5. Access to these forward posts for adjustment is provided by a pair of holes 13*c* in case 6 through which a screwdriver may reach the solts 13*b*** in the tops of the posts. It will be appreciated that a maximum range of adjustment is possible by the use of adjustable posts at both the forward and the rear ends of the latch bolt.

It will be understood that the concept of the invention herein described by way of example as incorporated in a spring latch is applicable to any latch or lock, whether spring or positive bolt, having a bolt action comparable to that described. The adjustability of the angle of emergence of the bolt makes it possible not only to easily do a good installing job but also to maintain good working order throughout the useful life of the latched or locked door.

I claim:

1. In a hinged door latch comprising a bolt case adapted to be mounted upon a door, a bolt arranged for axial reciprocating movement within said case and including a catch at the forward end thereof, and means for moving said bolt in extension and retraction to latch and unlatch the door, the improvement which comprises means affixed to and carried by said bolt for adjusting the angle of emergence of said bolt whereby to laterally adjust the extended position of said catch, said means comprising a post mounted for axial adjustment transversely of said bolt at the rear end thereof, said post extending in sliding relationship between top and bottom inner surfaces of the bolt case, and a fulcrum element mounted transversely of the bolt in the forward portion thereof rearwardly of the catch, said fulcrum element extending in sliding relationship between top and bottom inner surfaces of the bolt case.

2. Structure in accordance with claim 1 wherein a second fulcrum element is mounted in the bolt, the two fulcrum elements being spaced apart along a line at right angles to the axis of said bolt.

3. Structure in accordance with claim 2 wherein the two fulcrum elements are transversely adjustable with respect to the bolt.

4. Structure in accordance with claim 3 wherein holes are provided in a wall of the bolt case for access to the two adjustable fulcrum elements.

5. Structure in accordance with claim 1 wherein the post is screw mounted in the bolt whereby its position is adjustable by turning said post and a hole is provided in a wall of the case for access to said post for adjusting the same.

6. Structure in accordance with claim 5 wherein at least the end surfaces of the post and fulcrum element are formed by a self lubricating plastic material.

7. In a hinged door latch comprising a bolt case adapted to be mounted upon a door, a bolt arranged for axial reciprocating movement within said case and including a catch at the forward end thereof, and means for moving said bolt in extension and retraction to latch and unlatch the door, the improvement which comprises means affixed to and carried by said bolt for adjusting the angle of emergence of said bolt whereby to laterally adjust the extended position of said catch, said means comprising at least one post mounted for axial adjustment transversely of said bolt at the forward end thereof rearwardly of said catch, said post extending in sliding relationship between top and bottom inner surfaces of the bolt case, and a spacing element mounted in the bolt in fixed relation thereto at the rear end thereof and extending between top and bottom inner surfaces of the bolt case in sliding relationship therewith.

* * * * *